US010344491B2

(12) United States Patent
Mjelde

(10) Patent No.: US 10,344,491 B2
(45) Date of Patent: Jul. 9, 2019

(54) POOL DRAIN WITH WATER DIVERSION FEATURES

(71) Applicant: Olaf Mjelde, Ventura, CA (US)

(72) Inventor: Olaf Mjelde, Ventura, CA (US)

( * ) Notice: Subject to any disclaimer, the term of this patent is extended or adjusted under 35 U.S.C. 154(b) by 0 days.

(21) Appl. No.: 15/217,892

(22) Filed: Jul. 22, 2016

(65) Prior Publication Data

US 2018/0023311 A1 Jan. 25, 2018

(51) Int. Cl.
*E04H 4/12* (2006.01)

(52) U.S. Cl.
CPC ..... *E04H 4/1236* (2013.01); *E04H 4/1209* (2013.01)

(58) Field of Classification Search
CPC ..... E04H 4/1236; E04H 4/14
USPC ..... 4/507, 509
See application file for complete search history.

(56) References Cited

U.S. PATENT DOCUMENTS 6,170,095 B1 * 1/2001 Zars ..... E04H 4/1236 4/507
6,615,417 B1 * 9/2003 Newhard ..... E04H 4/1236 4/507
6,810,537 B1 * 11/2004 Barnes ..... E04H 4/1236 4/507
7,774,870 B2 * 8/2010 Griffin ..... E04H 4/1236 4/507
7,788,743 B2 * 9/2010 Mjelde ..... E04H 4/1236 4/507
7,992,236 B2 * 8/2011 Degooyer ..... E03F 5/0408 4/287
8,239,974 B2 * 8/2012 Erlebach ..... E03F 5/04 4/286
2006/0015996 A1 * 1/2006 Goettl ..... E04H 4/1236 4/507
2009/0019633 A1 * 1/2009 Snow ..... E04H 4/1218 4/504
2009/0320204 A1 * 12/2009 Wiseman ..... A47K 3/40 4/613
2012/0023658 A1 * 2/2012 Bobeck ..... E03F 5/0408 4/679
2012/0297531 A1 * 11/2012 Newhard ..... E04H 4/1236 4/504
2014/0157510 A1 * 6/2014 Mjelde ..... E04H 4/1236 4/510
2014/0250581 A1 * 9/2014 Mjelde ..... E04H 4/1236 4/507

* cited by examiner

*Primary Examiner* — Tuan N Nguyen
(74) *Attorney, Agent, or Firm* — Rosenberg, Klein & Lee

(57) ABSTRACT

A pool drain for flush mounting in the surface of a swimming pool includes a central hub and elongated drain ports in fluid communication with the central hub. The elongated drain ports extend radially away from the central hub. The surface material individually surrounds the central hub and elongated drain ports when the pool drain is installed in the surface material. Internal dividers are located between the central hub and the elongated drain ports. The internal dividers are positioned so that they direct fluid away from the central hub, around each of the internal dividers and back toward the central hub. A water stop surrounding the central hub and elongated drain ports anchors the pool drain in the surface and prevents leakage.

21 Claims, 4 Drawing Sheets

POOL DRAIN WITH WATER DIVERSION FEATURES

BACKGROUND

Pool drains with enlarged or elongated channel sumps are popular in view of their compliance with the Virginia Graham Baker Pool & Spa Safety Act ("VGB Act"), requiring swimming pool and spa drains to prevent body parts from covering the entire drain intake and becoming entrapped. Anti-entrapment channel drains generally comply with the VGB Act by providing multiple intake ports or being of a sufficient length that they cannot be simultaneously blocked. For example, if one drain port or a portion of a drain port is blocked, the other drain intake ports allow water to continue flowing into the drain, ensuring a low pressure differential at the intake. One example of such a drain is embodied in Applicant's U.S. Pub. No. 2014/0157510, which discloses a channel drain having a water stop for embedding in the surface of a pool.

Pool drains having drain intakes separated from a central hub are also known in the art. These drains are typically installed in the plaster surface of a pool with the water transit between the drain intake and the central hub embedded in the plaster surface. While more aesthetically pleasing than a drain having an intake and filter connection at the same location, these drains are typically limited to a circular design. One example of such a drain is embodied in Applicant's U.S. Pub. No. 2014/0250581, which discloses a circular drain intake separate from and encircling a central drain hub. In addition to the limited design appearance of these drains, a problem persists in that if the drain intake is not equidistant from the central hub, a pressure differential is created at portions of the intake closer to the hub. For this reason, these drains remain limited to their circular shape.

Thus there is a need for a pool drain that provides a large or lengthy intake, and wherein the drain intake is separated from a central hub. There is also a need for such a drain that can be produced in an aesthetic shape other than circular, but which maintains an even pressure differential across all drain intakes regardless of distance from the central hub. A drain accomplishing these and other objects is disclosed in the following summary, description and claims.

SUMMARY

A pool drain for flush mounting in a surface material of a swimming pool or spa having a pump-driven filtering system, the pool drain includes a central hub having an access port. The central hub is in fluid communication with the pump-driven filtering system. A plurality of elongated drain ports are in fluid communication with the central hub, and the plurality of elongated drain ports extend radially away from the central hub. The surface material individually surrounds the access port and each of the plurality of elongated drain ports, separating the elongated drain ports from the access port when the pool drain is installed in the surface material.

The pool drain also includes a removable lid covering the access port and a plurality of internal dividers, Each of the internal dividers is disposed between the central hub and one of the plurality of elongated drain ports. The plurality of internal dividers are positioned to direct fluid away from the central hub, around the plurality of internal dividers and back toward the central hub.

A water stop surrounds the central hub to anchor the central hub within the surface material and prevent leakage.

The pool drain may include a plurality of water stops surrounding each of the plurality of elongated drain ports to anchor the plurality of elongated drain ports within the surface material and prevent leakage.

In some embodiments, the plurality of elongated drain ports comprises four elongated drain ports. The plurality of drain ports may also comprise two longitudinal drain ports oriented along a longitudinal axis and two lateral drain ports oriented along a lateral axis. In such a configuration, the longitudinal drain ports and the lateral drain ports are substantially narrower than the access port.

The pool drain may also be configured as having a central hub in fluid communication with the pump-driven filtering system, with an arm extending from the central hub, the arm coupling an elongated drain port to the central hub. The arm has an internal divider partially occluding the arm and the internal divider is positioned in the arm to direct fluid entering the elongated drain port away from the central hub, around the internal divider, and back toward the central hub.

In this configuration, the pool drain preferably includes a removable lid covering the central hub, and a water stop surrounding the central hub to anchor the central hub within the surface material and prevent leakage. The pool drain also includes a water stop surrounding the elongated drain port to anchor the elongated drain port within the surface material and prevent leakage. This configuration may also include a plurality of arms, each having an elongated drain port. Typically the plurality of arms consists of two opposing longitudinal arms arranged substantially perpendicular to two opposing lateral arms.

In another configuration, the pool drain includes a central hub having an access port, the central hub in fluid communication with the pump-driven filtering system. Two longitudinal elongated drain ports extend away from the central hub in opposing directions along a first axis and two lateral elongated drain ports extend away from the central hub in opposing directions along a second axis, with the first axis substantially perpendicular to the second axis.

In this configuration the pool drain includes a removable lid covering the access port and a plurality of internal dividers disposed between the central hub and each of the longitudinal elongated drain ports and the lateral elongated drain ports. The internal dividers are positioned to direct fluid away from the central hub, around the plurality of internal dividers and back toward the central hub, and the pool drain may include a water stop surrounding the central hub, the longitudinal elongated drain ports and the lateral elongated drain ports for anchoring the pool drain in the surface material to prevent leakage.

DESCRIPTION

Figure 1:
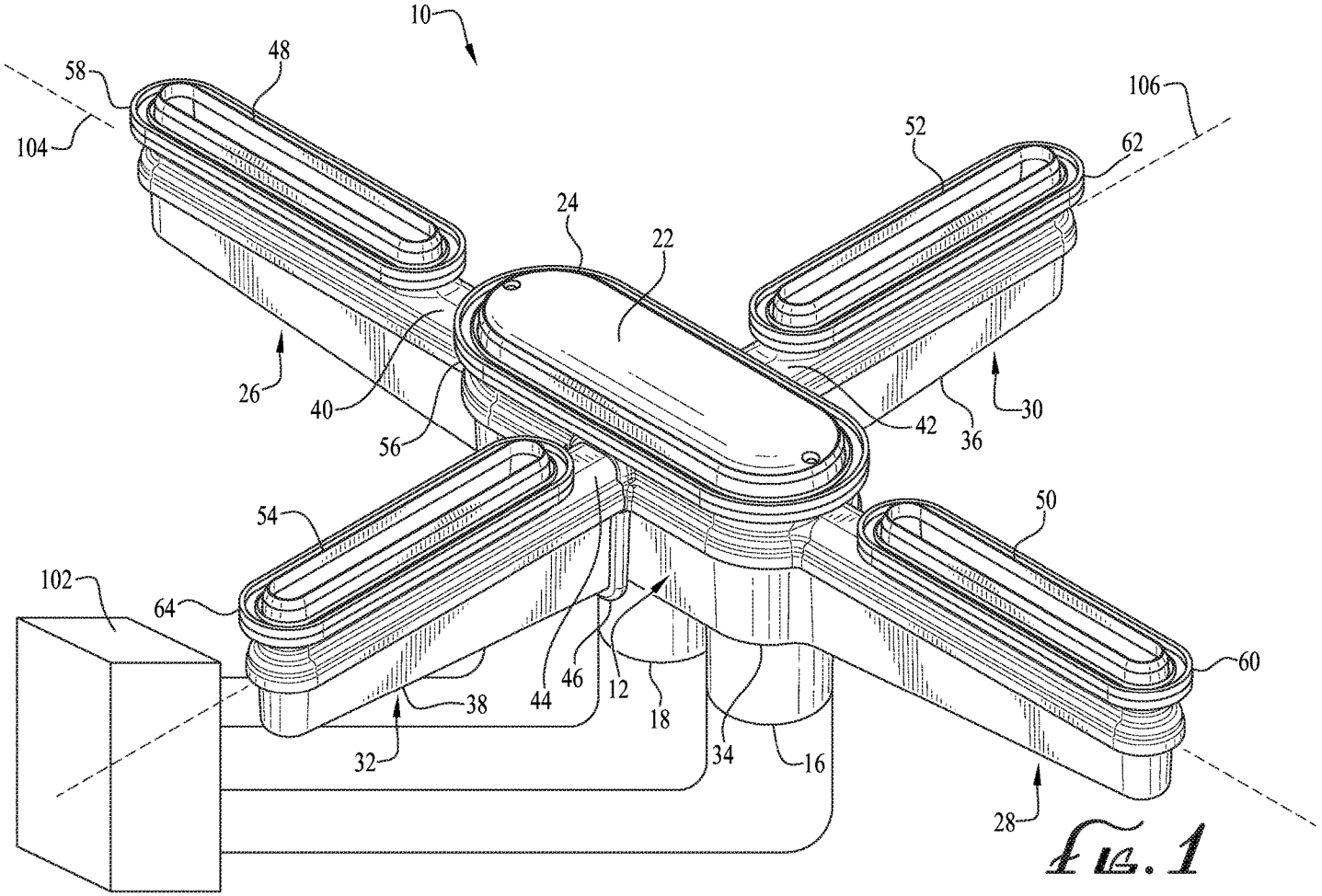
FIG. 1 illustrates a perspective view showing the top side of a pool drain having water diversion features.
Figure 2:
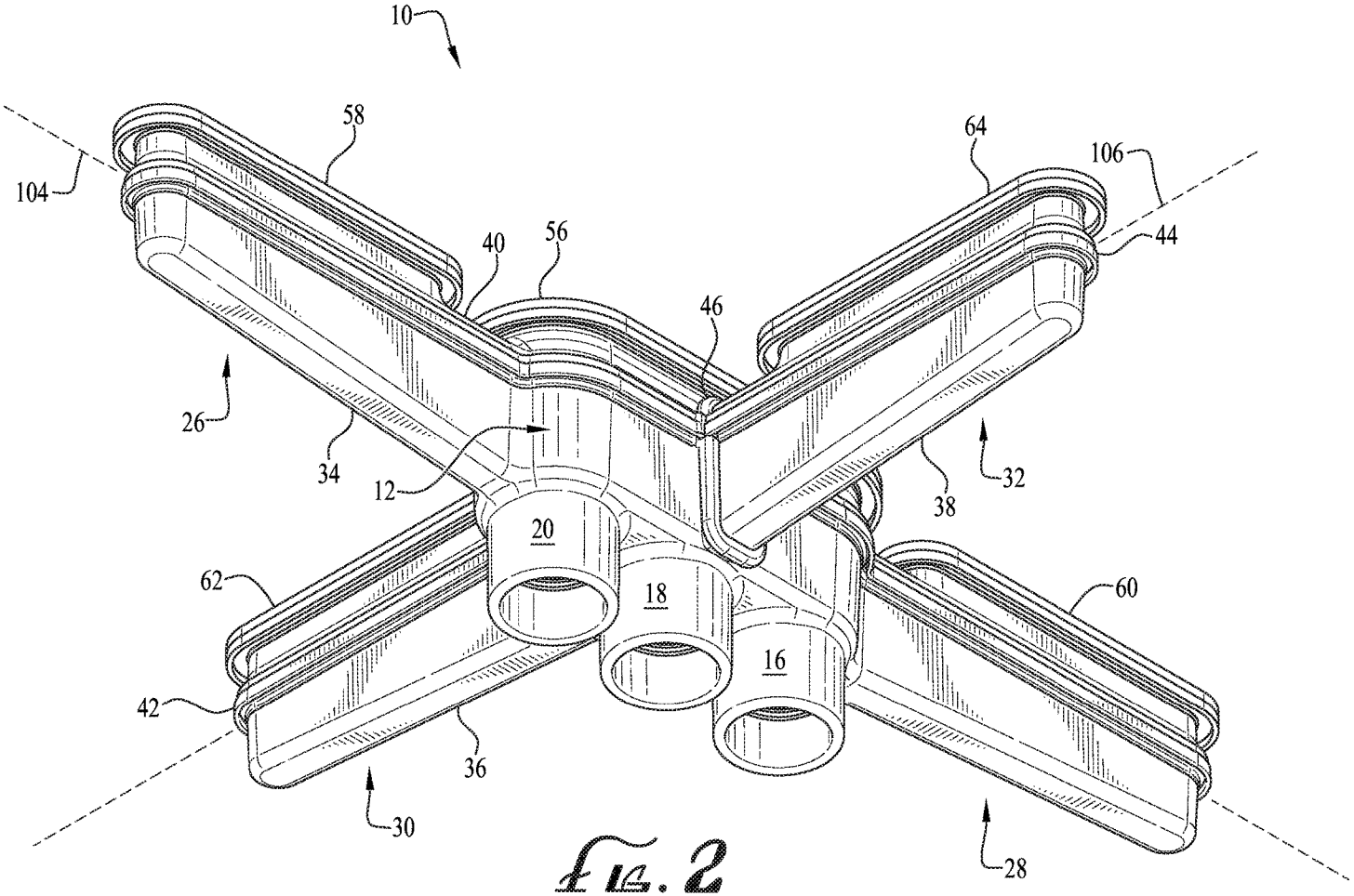
FIG. 2 illustrates a perspective view showing the bottom side of the pool drain.
Figures 3, 5:
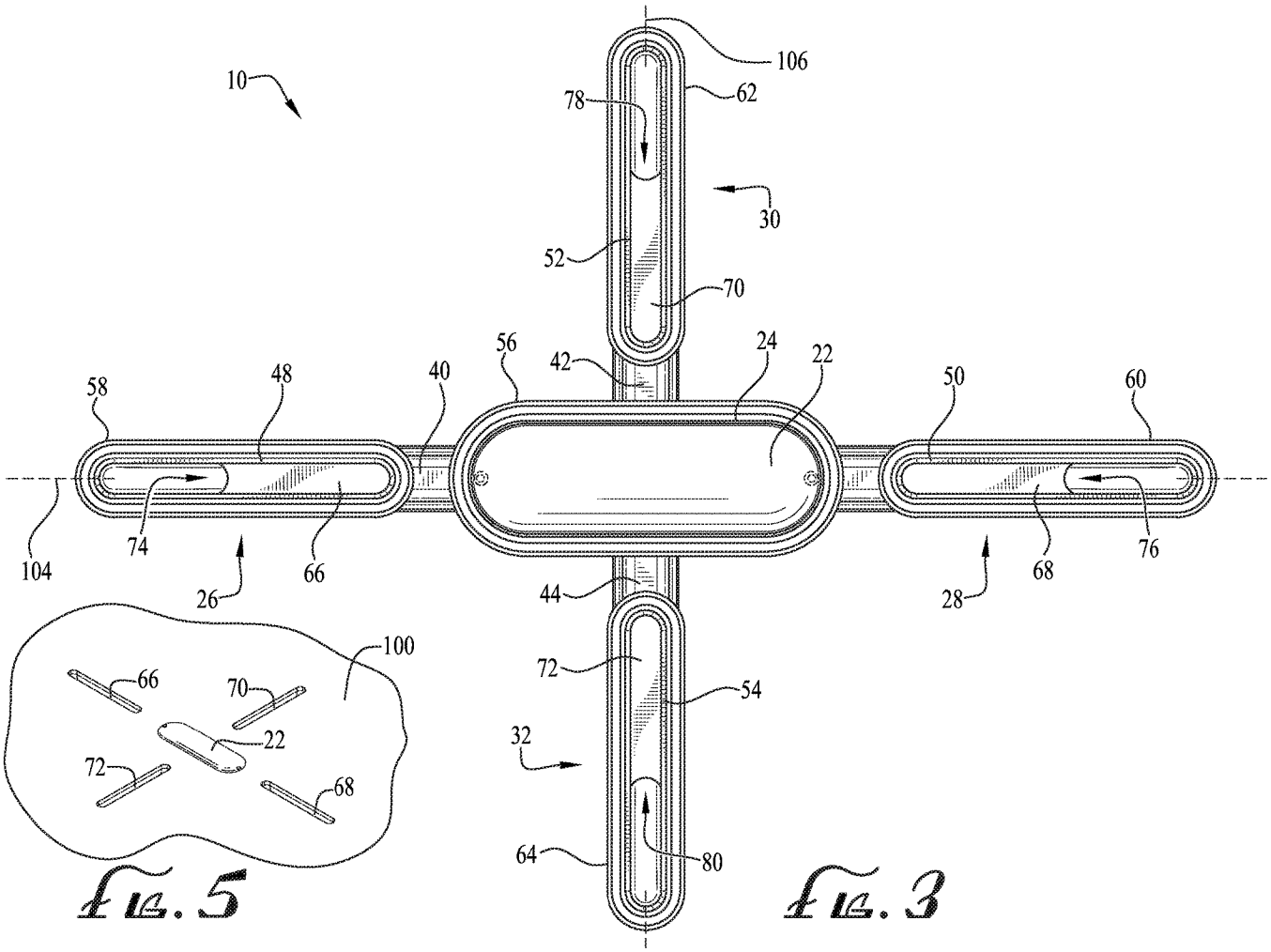
FIG. 3 illustrates a top view of the of the pool drain.
FIG. 5 illustrates a plaster surface of a pool showing the pool drain installed therein.
Figure 4:
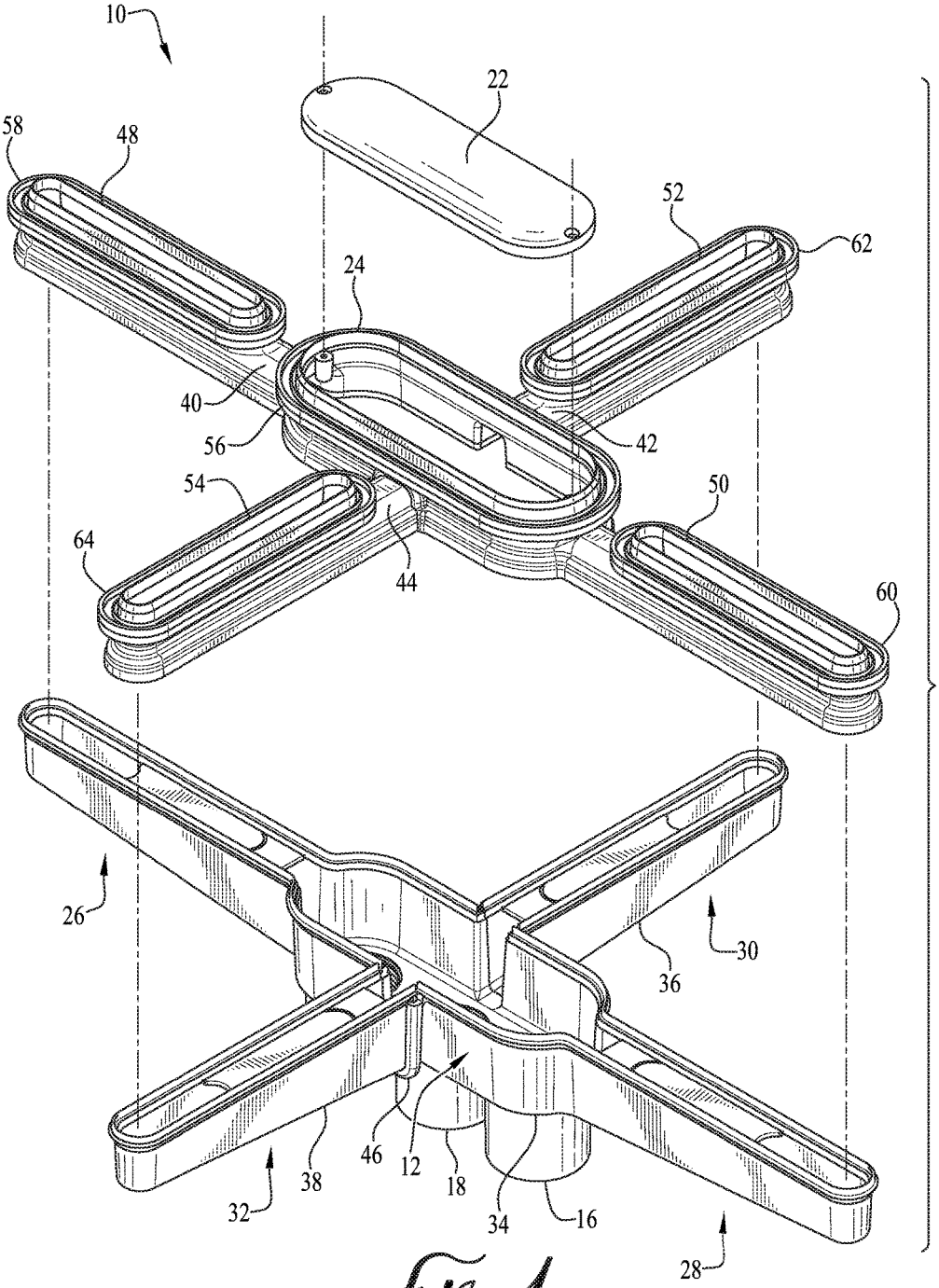
FIG. 4 illustrates an exploded view of the pool drain.

Referring to FIGS. 1-4, a pool drain with water diversion features ("pool drain") 10 includes a central hub 12 the central hub 12 forming a sump 14 for installation in the plaster surface 100 of a swimming pool or spa having a pump-driven filtering system 102. The central hub 12 includes a first tube 16, second tube 18 and third tube 20 for drainage and connecting to the pump-driven filtering system 102. The central hub 12 also includes a lid 22 for cleaning out the central hub 12 in the unlikely event the central hub 12 becomes clogged with debris. The lid 22 seats in an access port 24 and may be fastened to the access port 24 with tools necessary for removal to prevent unauthorized access.

A first longitudinal arm 26 and second longitudinal arm 28 extend from the central hub 12. Preferably the first longitudinal arm 26 and second longitudinal arm 28 are oriented in opposing directions away from the central hub 12. A first lateral arm 30 and second lateral arm 32 also extend from the central hub 12. Preferably the first lateral arm 30 and second lateral arm 32 are also oriented in opposing directions away from the central hub 12, perpendicular to the first longitudinal arm 26 and second longitudinal arm 28. Water enters the pool drain 10 through the first longitudinal arm 26, second longitudinal arm 28, first lateral arm 30 and second lateral arm 32 and travels to the central hub 12. Additionally, the first longitudinal arm 26, second longitudinal arm 28, first lateral arm 30 and second lateral arm 32 impart a distinctive cross shape to the pool drain 10 on the pool's plaster surface 100.

To provide for economical manufacturing and transport, the pool drain 10 may comprise several component parts assembled on site during pool installation. A longitudinal basin 34 forms lower portions of the central hub 12, and lower portions of the first longitudinal arm 26 and second longitudinal arm 28. A first lateral basin 36 and a second lateral basin 38, molded separately, form lower portions of the first lateral arm 30 and second lateral arm 32, respectively. The first lateral basin 36 and second lateral basin 38 may be packaged parallel to the longitudinal basin 34, including being nested in the longitudinal basin 34 to fit in a smaller package for transport.

Since the longitudinal basin 34, first lateral basin 36 and second lateral basin 38 are open-topped, a complimentary longitudinal basin cover 40 is preferably included, forming upper portions of the central hub 12, first longitudinal arm 26 and second longitudinal arm 28. Likewise, a first lateral basin cover 42 and a second lateral basin cover 44, form upper portions of the first lateral arm 30 and second lateral arm 32. The longitudinal basin cover 40, first lateral basin cover 42 and second lateral basin cover 44 may also be stored in a parallel or nested configuration with other components of the pool drain 10 for ease of packaging and transport.

To ensure efficiently assembly of the pool drain 10, connectors 46 are provided. In one embodiment the connectors 46 are formed as part of the longitudinal basin 34, and affix the first lateral basin 36 and second lateral basin 38 to it. In the illustrated embodiment, a sliding channel-and-rail connector 46 is shown, although any preferred substantially water tight connection is contemplated. In another contemplated embodiment, the longitudinal basin cover 40 seats over the first lateral basin cover 42 and the second lateral basin cover 44, thereby locking them over the first lateral basin 36 and second lateral basin 38 when the longitudinal basin cover 40 seats over the longitudinal basin 34.

The longitudinal basin cover 40, in addition to the access port 24, includes a first elongated drain port 48 located over the first longitudinal arm 26 and a second elongated drain port 50 located over the second longitudinal arm 28. A third elongated drain port 52 is located over the first lateral arm 30 and a fourth elongated drain port 54 is located over the second lateral arm 32. The elongated drain ports 48-54 are all preferably substantially the same size and elongated shape, and are separated from the access port 24, thereby providing an interesting and aesthetic appearance to the pool drain 10 by providing a cross shape when installed.

To secure the pool drain 10 in pool plaster or similar surfacing material (not shown) a hub water stop 56 is formed around the access port 24. Similarly, a first drain port water stop 58 is formed around the first elongated drain port 48, a second drain port water stop 60 is formed around the second elongated drain port 50, a third drain port water stop 62 is formed around the third elongated drain port 52, and a fourth drain port water stop 64 is formed around the fourth elongated drain port 54.

Since the elongated drain ports 48-54 are oriented along the first longitudinal arm 26, second longitudinal arm 28, first lateral arm 30 and second lateral arm 32, respectively, greater suction forces are created in the elongated drain ports 48-54 as they near the central hub 12. Correspondingly, lesser suction forces are created in the elongated drain ports 48-54 at a greater distance from the central hub 12. Thus a disfavored uneven pressure differential is created in each of the elongated drain ports 48-54. To solve this problem, a first internal divider 66 is placed in the first elongated drain port 48, a second internal divider 68 is placed in the second elongated drain port 50, a third internal divider 70 is placed in the third elongated drain port 52 and a fourth internal divider 72 is placed in the fourth elongated drain port 54.

The internal dividers 66-72, like the elongated drain ports 48-54, are preferably of substantially equal size and shape. The internal dividers 66-72 are each seated below in the elongated drain ports 48-54, and located closer to the central hub 12 to shift the direction of water entering the elongated drain ports 48-54 away from the central hub 12. The internal dividers 66-72 don't completely occlude the elongated drain ports 48-54. Instead, the first internal divider 66 creates a first water passage 74 in the first elongated drain port 48, the second internal divider 68 creates a second water passage 76 in the second elongated drain port 50, the third internal divider 70 creates a third water passage 78 in the third elongated drain port 52 and the fourth internal divider 72 creates a fourth water passage 80 in the fourth elongated drain port 54.

The water passages 74-80 cause water entering the pool drain 10 to travel initially away from the central hub 12 before traveling back toward the central hub 12 through the first longitudinal arm 26, second longitudinal arm 28, first lateral arm 30 and second lateral arm 32, thereby equalizing suction pressure at the elongated drain ports 48-54.

The pool drain's 10 structure having been shown and described, its method of manufacture, assembly and operation will now be discussed.

To form the components of the pool drain 10, a open-topped longitudinal basin 34 is formed, having lower portions of a first longitudinal arm 26 and a second longitudinal arm 28 oriented in opposition away from a central hub 12. Also formed in the longitudinal basin 34 are a first tube 16, second tube 18 and third tube 20 serving as outflows for connecting to a pump driven pool filter. An open-topped first lateral basin 36 and second lateral basin 38, forming lower portions of the first lateral arm 30 and second lateral arm 32 are also formed.

A longitudinal basin cover 40 is formed for covering the longitudinal basin 34. A first lateral basin cover 42 and a second lateral basin cover 44 are also formed for covering the first lateral basin 36 and second lateral basin 38, respectively. The longitudinal basin cover 40 has an access port 24, a first elongated drain port 48 and a second elongated drain port 50 formed therein. A third elongated drain port 52 is incorporated into the first lateral basin cover 42, and a fourth elongated drain port 54 is incorporated into the second lateral basin cover 44. Internal dividers 66-72 sized to partially occlude the elongated drain ports 48-54 are also created.

These components (including a lid 22 for covering the access port 24) may be aligned and preferably nested to fit in a relatively small and elongated package for transport. Also preferably included is a hub water stop 56 for installation around the access port 24, and drain port water stops 58-64 for installation around the elongated drain ports 48-54. In one preferred embodiment, the hub water stop 56 and drain port water stops 58-64 may be formed as part of the longitudinal basin cover 40, first lateral basin cover 42 and second lateral basin cover 44 through injection molding or similar technology.

To construct the pool drain 10, the first lateral basin 36 and the second lateral basin 38 are joined to the longitudinal basin 34 at the central hub 12 with connectors 46, preferably in a sliding arrangement. Thereafter, the internal dividers 66-72 are installed above the longitudinal basin 34 adjacent the central hub 12, and above the first lateral basin 36 and the second lateral basin 38. The first lateral basin cover 42 and second lateral basin cover 44 are then installed over the first lateral basin 36 and second lateral basin 38, and the longitudinal basin cover 40 is installed over the longitudinal basin 34, locking the first lateral basin cover 42 and second lateral basin cover 44 in place. If not integrally formed, the hub water stop 56 and drain port water stops 58-64 are installed over the central hub 12 and elongated drain ports 48-54, respectively. The lid 22 is placed in the access port 24 to close the central hub 12.

To install the pool drain 10, the first tube 16, second tube 18 and third tube 20 are installed on pipes leading to the pump-driven filtering system 102 during initial construction of the pool. When the pool is plastered or surfaced with a similar material, the plaster surface 100 surrounds the pool drain 10 up to the entrances of the access port 24, first elongated drain port 48, second elongated drain port 50, third elongated drain port 52 and fourth elongated drain port 54. In the process, plaster completely surrounds the hub water stop 56, first drain port water stop 58, second drain port water stop 60, third drain port water stop 62 and fourth drain port water stop 64, thereby securing the pool drain 10 in the plaster and preventing cracking an leakage.

In operation, when the pump-driven filtering system 102 is activated, water is drawn toward the pool drain 10 from suction pressure. The water must travel around the internal dividers 66-72 before passing through the water passages 74-80, which equalizes suction pressure along the elongated drain ports 48-54. Once the water clears the internal dividers 66-72, it travels through the first longitudinal arm 26, second longitudinal arm 28, first lateral arm 30 and second lateral arm 32 and into the central hub 12 before leaving the pool drain 10 through the first tube 16, second tube 18 and third tube 20. If one or more of the tubes 16-20 becomes blocked, a user may simply deactivate the pump-driven filtering system, remove the lid 22 and clear the debris from the central hub 12. With the debris removed, the lid 22 may be replaced and the pump-driven filtering system 102 reactivated.

The pool drain 10 provides for an attractive and aesthetic cross pattern on the surface 100 of the pool which also avoids entrapment hazards by creating even suction pressure at multiple elongated drain ports 48-54.

What is claimed is:

1. A pool drain for flush mounting in a surface material of a swimming pool or spa having a pump-driven filtering system, the pool drain comprising:

a central hub having an access port, the central hub in fluid communication with the pump-driven filtering system;

a plurality of elongated drain ports in fluid communication with the central hub, the plurality of elongated drain ports extending radially away from the central hub;

an internal divider disposed beneath each elongated drain port, the internal divider partially occluding an internal space to deflect a portion of fluid entering through the elongated drain port, the internal divider being configured to direct the portion of fluid to pass around and under a surface thereof toward a drainage tube of the central hub for equalizing suction pressure at the elongated drain port; and wherein the surface material individually surrounds the access port and each of the plurality of elongated drain ports separating the elongated drain ports from the access port when the pool drain is installed in the surface material.

2. The pool drain of claim 1 further comprising a removable lid covering the access port.

3. The pool drain of claim 1 further comprising a plurality of internal dividers, each of the internal dividers disposed between the central hub and one of the plurality of elongated drain ports.

4. The pool drain of claim 3 wherein the plurality of internal dividers are positioned to direct fluid away from the central hub, around the plurality of internal dividers and back toward the central hub.

5. The pool drain of claim 1 further comprising a water stop surrounding the central hub to anchor the central hub within the surface material and prevent leakage.

6. The pool drain of claim 1 further comprising a plurality of water stops surrounding each of the plurality of elongated drain ports to anchor the plurality of elongated drain ports within the surface material and prevent leakage.

7. The pool drain of claim 1 wherein the plurality of elongated drain ports comprises four elongated drain ports.

8. The pool drain of claim 1 wherein the plurality of drain ports comprises two longitudinal drain ports oriented along a longitudinal axis and two lateral drain ports oriented along a lateral axis.

9. The pool drain of claim 8 wherein the longitudinal drain ports and the lateral drain ports are substantially narrower than the access port.

10. The pool drain of claim 1 further comprising a water stop surrounding the central hub, the longitudinal elongated drain ports and the lateral elongated drain ports for anchoring the pool drain in the surface material to prevent leakage.

11. A pool drain for installation in a surface material of a swimming pool or spa, and connection to a pump-driven filtering system, the pool drain comprising:

a central hub in fluid communication with the pump-driven filtering system;

an elongated drain port forming an upper portion of an arm, the arm extending from the central hub and coupling the elongated drain port to the central hub;

the arm having an internal divider partially occluding the arm to deflect a portion of fluid entering the arm through the elongated drain port; and the internal divider being configured and positioned in the arm to direct the portion of fluid to pass around and under a surface thereof toward a drainage tube of the central hub for equalizing suction pressure at the elongated drain port.

12. The pool drain of claim 11 further comprising a removable lid covering the central hub.

13. The pool drain of claim 11 further comprising a water stop surrounding the central hub to anchor the central hub within the surface material and prevent leakage.

14. The pool drain of claim 11 further comprising a water stop surrounding the elongated drain port to anchor the elongated drain port within the surface material and prevent leakage.

15. The pool drain of claim 11 further comprising a plurality of arms, each having an elongated drain port.

16. The pool drain of claim 15 wherein the plurality of arms consists of two opposing longitudinal arms arranged substantially perpendicular to two opposing lateral arms.

17. The pool drain of claim 11, wherein the arm extends radially away from the central hub.

18. A pool drain for flush mounting in a surface material of a swimming pool or spa having a pump-driven filtering system, the pool drain comprising:

a central hub having an access port, the central hub in fluid communication with the pump-driven filtering system;

two longitudinal elongated drain ports extending away from the central hub in opposing directions along a first axis;

two lateral elongated drain ports extending away from the central hub in opposing directions along a second axis;

an internal divider disposed beneath each of the elongated drain ports, the internal divider partially occluding an internal space to deflect a portion of fluid entering through the elongated drain port, the internal divider being configured to direct the portion of fluid to pass around and under a surface thereof toward a drainage tube of the central hub for equalizing suction pressure at the elongated drain port; and wherein the first axis is substantially perpendicular to the second axis.

19. The pool drain of claim 18 further comprising a removable lid covering the access port.

20. The pool drain of claim 18 further comprising a plurality of internal dividers disposed between the central hub and each of the longitudinal elongated drain ports and the lateral elongated drain ports.

21. The pool drain of claim 18 wherein the plurality of internal dividers are positioned to direct fluid away from the central hub, around the plurality of internal dividers and back toward the central hub.

* * * * *